US012790967B2

(12) United States Patent
Burkholder

(10) Patent No.: US 12,790,967 B2
(45) Date of Patent: Nov. 10, 2026

(54) PLATE VALVE FOUR STROKE HEAD

(71) Applicant: Steve Burkholder, Annapolis, MD (US)

(72) Inventor: Steve Burkholder, Annapolis, MD (US)

( * ) Notice: Subject to any disclaimer, the term of this patent is extended or adjusted under 35 U.S.C. 154(b) by 0 days.

(21) Appl. No.: 19/226,418

(22) Filed: Jun. 3, 2025

(65) Prior Publication Data

US 2025/0290434 A1 Sep. 18, 2025

Related U.S. Application Data

(63) Continuation-in-part of application No. 17/616,962, filed as application No. PCT/US2020/035877 on Jun. 3, 2020, now Pat. No. 12,345,182.

(60) Provisional application No. 62/856,402, filed on Jun. 3, 2019.

(51) Int. Cl.

| | |
|---|---|
| ***F01L 7/06*** | (2006.01) |
| ***F01L 7/14*** | (2006.01) |
| ***F01L 7/16*** | (2006.01) |

(52) U.S. Cl.

CPC *F01L 7/06* (2013.01); *F01L 7/14* (2013.01); *F01L 7/16* (2013.01); *F01L 2810/02* (2013.01)

(58) Field of Classification Search

CPC ..... F01L 7/06; F01L 7/14; F01L 7/16; F01L 2810/02; F01M 9/10; F01M 9/109; F02F 1/4285

See application file for complete search history.

(56) References Cited

U.S. PATENT DOCUMENTS

| | | | | |
|---|---|---|---|---|
| 2,028,138 A * | 1/1936 | Coulling | ..... | F01L 5/02 123/188.4 |
| 4,418,658 A | 12/1983 | DiRoss | | |
| 4,550,696 A | 11/1985 | Ehrlich | | |
| 4,838,220 A | 6/1989 | Parsons | | |
| 5,040,498 A | 8/1991 | Scherer | | |
| 5,542,385 A * | 8/1996 | Kim | ..... | F02D 9/14 123/184.52 |
| 5,558,049 A | 9/1996 | Dubose | | |

(Continued)

FOREIGN PATENT DOCUMENTS

| | | |
|---|---|---|
| CN | 105927306 A | 9/2016 |
| DE | 1121405 B | 1/1962 |

(Continued)

OTHER PUBLICATIONS

Australian Office Action dated Mar. 23, 2022.

(Continued)

*Primary Examiner* — Grant Moubry
(74) *Attorney, Agent, or Firm* — Dickinson Wright, PLLC

(57) ABSTRACT

A head, for an internal combustion engine, is provided, the head including a base and intake and exhaust assemblies supported by the base and rotatable to open and close intake and exhaust ports formed in the base. The intake and exhaust assemblies each include a plate with an opening therein and rotatable between a position in which the opening in the plate is aligned with and opens one of the intake port and exhaust port and a position in which the plate closes the intake port or exhaust port. Sealing devices provide seals between the plates and the intake and exhaust ports.

11 Claims, 11 Drawing Sheets

(56) References Cited

U.S. PATENT DOCUMENTS

| | | | | |
|---|---|---|---|---|
| 5,596,966 | A * | 1/1997 | Elder | F02B 27/0263 123/184.55 |
| 5,694,890 | A * | 12/1997 | Yazdi | F01L 5/02 123/58.9 |
| 5,713,314 | A | 2/1998 | Beare | |
| 8,127,734 | B2 * | 3/2012 | Jolley, Jr. | F01L 5/02 123/188.5 |
| 10,655,510 | B2 * | 5/2020 | Murakami | F16K 31/0668 |
| 2008/0041325 | A1 | 2/2008 | Agapiades | |
| 2010/0006054 | A1 | 1/2010 | Jolley, Jr. | |
| 2014/0238358 | A1 | 8/2014 | Arens | |

FOREIGN PATENT DOCUMENTS

| | | | |
|---|---|---|---|
| DE | 10323594 | A1 | 12/2004 |
| EP | 1983163 | A1 | 10/2008 |
| JP | H01-080709 | | 3/1989 |
| JP | H08-232620 | A | 9/1996 |
| KR | 1020110037201 | A | 4/2011 |
| WO | 9954600 | A1 | 10/1999 |
| WO | 2011129799 | A1 | 10/2011 |

OTHER PUBLICATIONS

Second Preliminary Decision received by Australian Patent Office dated Jul. 19, 2024.

Japanese Office Action issued in Japanese Patent Application No. 2021-571917 dated May 16, 2023.

Japanese Office Action issued in Japanese Patent Application No. 2021-571917 dated Feb. 28, 2023.

* cited by examiner

PLATE VALVE FOUR STROKE HEAD

CROSS-REFERENCE TO RELATED APPLICATION

This Application is a Continuation-in-part of U.S. application Ser. No. 17/616,962, filed Dec. 6, 2021 in the U.S. Patent and Trademark Office, which is a National Stage Entry under 35 U.S.C. § 371, of International Application PCT/US2020/035877, filed Jun. 3, 2020, which claims the benefit of U.S. Provisional Patent Application 62/856,402, filed in the United States Patent and Trademark Office on Jun. 3, 3019, the disclosures of which are incorporated herein by reference in their entireties.

BACKGROUND

1. Field

Apparatuses and methods consistent with example embodiments relate to a head, for an internal combustion engine, using at least one plate to control the filling and emptying of the combustion chamber.

2. Description of the Related Art

Four stroke internal combustion engines almost exclusively use poppet type, intake and exhaust, valves to fill and empty the combustion chamber. The timing of the opening and closing of the valves is normally controlled by a cam. The cam opens and closes the valves relative to the stroke/crank location.

While the use of a poppet valve is nearly universal in four stroke engines, there are several design limitations of this arrangement. The complexity of the valve train has long been a design challenge, and a poppet valve is a reciprocating part which must be controlled very precisely for the engine to perform properly and reliably.

The poppet valve itself it has been proven a very reliable design. However, as the rotations per minute (rpms) of engines increase, the total weight of reciprocating parts, including pieces of the valve train, become crucial. Loads increase with higher engine speeds, reducing reliability. This creates a need for lighter stronger materials, which increases costs.

A typical poppet valve is held closed by a spring, and it is pushed open by one of several methods depending on the engine design. Ultimately a cam is used to push the valve open and the spring must be strong enough to overcome the inertia of the valve and reciprocating pieces of the valve train, travelling in the opening direction, and follow the cam profile as it allows the valve to close. However, as engine speeds increase, the inertia increases and stronger springs are needed. This puts greater loads on the valves and the other components in the valve train necessitating heavier components to handle the loads. The energy used to overcome these increased loads reduces the usable power output from the engine.

SUMMARY

Example embodiments may address at least the above problems and/or disadvantages and other disadvantages not described above. Also, example embodiments are not required to overcome the disadvantages described above, and may not overcome any of the problems described above.

According to one or more example embodiments, an engine head may comprise: a base configured to be attached to an end of a cylinder, such that a combustion chamber is defined by walls of the cylinder and a lower surface of the base, wherein the base comprises: a first counterbore formed therein and an intake opening disposed within the first counterbore and providing communication between an upper surface of the base and the lower surface of the base, and a second counterbore formed therein and an exhaust opening disposed within the second counterbore and providing communication between the upper surface of the base and the lower surface of the base; an intake assembly comprising a first plate disposed within the first counterbore and comprising a first opening therein, wherein the intake assembly is rotatable between a first closed position in which the first plate blocks the intake opening in the base, and a first open position in which the first opening in the intake plate is aligned with the intake opening in the base; an exhaust assembly comprising a second plate disposed within the second counterbore and comprising a second opening therein, wherein the exhaust assembly is rotatable between a second closed position in which the second plate blocks the exhaust opening in the base, and a second open position in which the second opening in the exhaust plate is aligned with the exhaust opening in the base; a first sealing device comprising a first upper ring and a first lower ring disposed in a first ring groove formed within the first counterbore around the intake opening, wherein the first upper ring is a continuous ring, and the first lower ring is a split ring; and a second sealing device comprising a second upper ring and a second lower ring disposed in a second ring groove formed within the second counterbore around the exhaust opening, wherein the second upper ring is a continuous ring, and the second lower ring is a split ring.

According to an example aspect of one or more example embodiments, the engine head may further comprise: a first bearing configured to support the first plate against a pressure in the combustion chamber; and a second bearing configured to support the second plate against a pressure in the combustion chamber.

According to an example aspect of one or more example embodiments, the first sealing device may further comprise a first spring disposed within the first ring groove, wherein the first spring is biased to exert pressure between the ring groove and the first lower ring; and the second sealing device may further comprise a second spring disposed within the second ring groove, wherein the second spring is biased to exert pressure between the second ring groove and the second lower ring.

According to an example aspect of one or more example embodiments, the base may further comprise a first shaft recess formed within the first counterbore and a second shaft recess formed within the second counterbore; the intake assembly may further comprise a first shaft fixed to and rotatable with the first plate, wherein the first shaft extends into the first shaft recess; and the exhaust assembly may further comprise a second shaft fixed to and rotatable with the second plate, wherein the second shaft extends into the second shaft recess.

According to an example aspect of one or more example embodiments, the engine head may further comprise: a first wiping device comprising a first wiper and a first spring disposed in a first wiper groove formed in the first counterbore and extending from the first shaft recess to an outer circumference of the first counterbore, wherein the first spring is disposed under the first wiper and is biased to exert upward pressure on the first wiper against a lower surface of the first plate; and a second wiping device comprising a second wiper and a second spring disposed in a second wiper groove formed in the second counterbore and extending from the second shaft recess to an outer circumference of the second counterbore, wherein the second spring is disposed under the second wiper and is biased to exert upward pressure on the second wiper against a lower surface of the second plate.

According to an example aspect of one or more example embodiments, the base may further comprise a first drain opening at the outer circumference of the first counterbore and in communication with the first wiper groove and a second drain opening in the outer circumference of the second counterbore and in communication with the second wiper groove.

According to an example aspect of one or more example embodiments, the engine head may further comprise: at least one oil passage in the engine head configured to provide oil under pressure to the first shaft recess and the second shaft recess.

According to one or more example embodiments, an engine head may comprise: a base configured to be attached to an end of a cylinder, such that a combustion chamber is defined by walls of the cylinder and a lower surface of the base, wherein the base comprises: a first counterbore formed therein and a first shaft recess formed within the first counterbore, and a second counterbore formed therein and a second shaft recess formed within the second counterbore; an intake rotor assembly comprising a first plate disposed in the first counterbore and a first shaft extending into the first shaft recess, wherein the first shaft is fixed to and rotatable with the first plate such that the intake rotor assembly is rotatable with respect to the base; an exhaust rotor assembly comprising a second plate disposed in the second counterbore and a second shaft extending into the second shaft recess, wherein the second shaft is fixed to and rotatable with the second plate such that the exhaust rotor assembly is rotatable with respect to the base; a first wiping device comprising a first wiper and a first spring disposed in a first wiper groove formed in the first counterbore and extending from the first shaft recess to an outer circumference of the first counterbore, wherein the first spring is disposed under the first wiper and is biased to exert upward pressure on the first wiper against a lower surface of the first plate; and a second wiping device comprising a second wiper and a second spring disposed in a second wiper groove formed in the second counterbore and extending from the second shaft recess to an outer circumference of the second counterbore, wherein the second spring is disposed under the second wiper and is biased to exert upward pressure on the second wiper against a lower surface of the second plate.

According to an example aspect of one or more example embodiments, the base may further comprise a first drain opening at the outer circumference of the first counterbore and in communication with the first wiper groove and a second drain opening in the outer circumference of the second counterbore and in communication with the second wiper groove.

According to an example aspect of one or more example embodiments, the engine head may further comprise: at least one oil passage in the engine head configured to provide oil under pressure to the first shaft recess and the second shaft recess.

According to an example aspect of one or more example embodiments, the engine head may further comprise: a first bearing configured to support the first plate against a pressure in the combustion chamber; and a second bearing configured to support the second plate against a pressure in the combustion chamber.

BRIEF DESCRIPTION OF THE DRAWINGS

The above and/or other aspects and advantages will become apparent and more readily appreciated from the following description of example embodiments, taken in conjunction with the accompanying drawings in which.

DETAILED DESCRIPTION

Figure 1A:
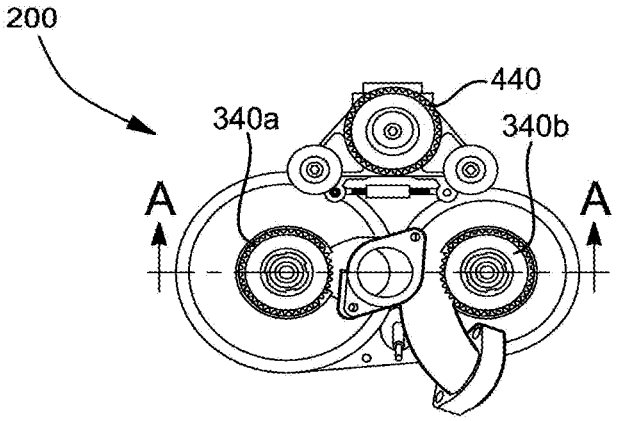
FIGS. 1A and 1B are a top view and a cross-sectional view of an engine according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise," and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as 'at least one of,' when preceding a list of elements, modify the entire list of elements and do not modify the individual elements of the list. In addition, the terms such as "unit," "-er (-or)," and "module" described in the specification refer to an element for performing at least one function or operation, and may be implemented in hardware, software, or the combination of hardware and software.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

Figure 1B:
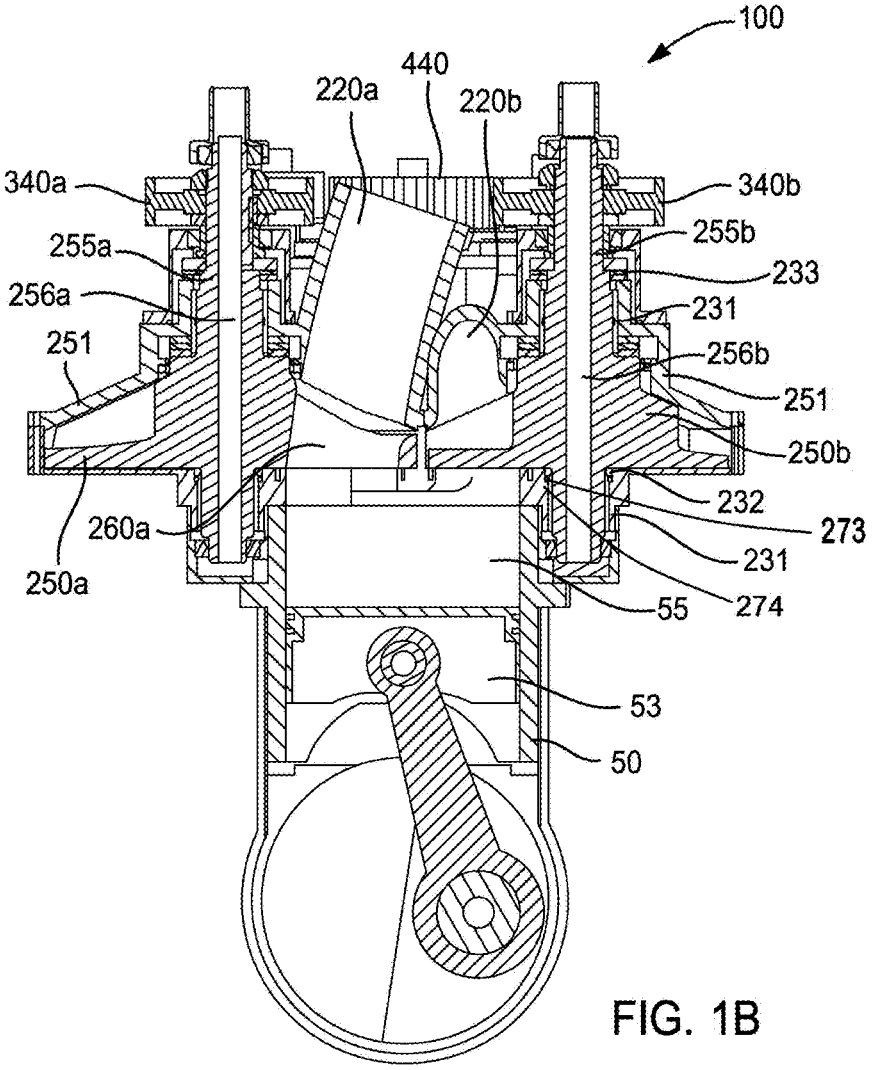

One or more example embodiments provide a head for an internal combustion four-stroke engine using at least one reciprocating piston in a cylinder bore. FIGS. 1A and 1B illustrate an engine 100 according to an example embodiment. FIG. 1A is a top view of the engine 100, and FIG. 1B illustrates a cross-section of the engine 100 taken along line A-A of FIG. 1A. The head 200 is mounted so that it covers the end of the cylinder 50 creating a combustion chamber 55 between the piston 53 and the head 200. Part of the head 200 is in communication with the combustion chamber 55 and may take any shape to achieve a desired combustion chamber shape and/or desired compression ratio. Bolts and/or studs with nuts may be used to mount the head 200 and to achieve a seal between the cylinder 50 and the head 200. Machined surfaces may be used to achieve the seal between the cylinder 50 and the head 200. However, this means should not be considered to be limiting, and a gasket, o-ring, or any other means may be used to achieve the seal, as would be understood by one of skill in the art. Alternatively the cylinder 50 and head 200 could be one piece.

Contained within the head 200 are at least two ports: an intake port 220*a* and an exhaust port 220*b*. Both the intake and exhaust ports 220*a* and 220*b* are in communication with the combustion chamber 55 at one end and with atmosphere at an opposite end.

Figure 2A:
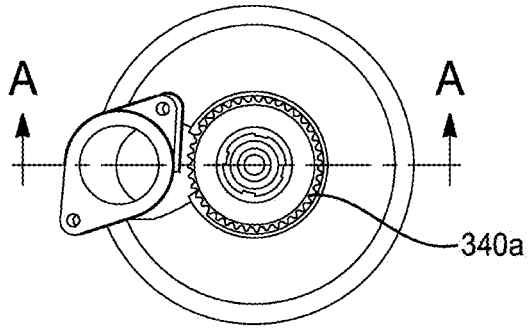
FIGS. 2A, 2B, and 2C are a top view, a cross-sectional view, and a perspective view, respectively, of an intake rotor system according to an example embodiment.
Figure 2B:
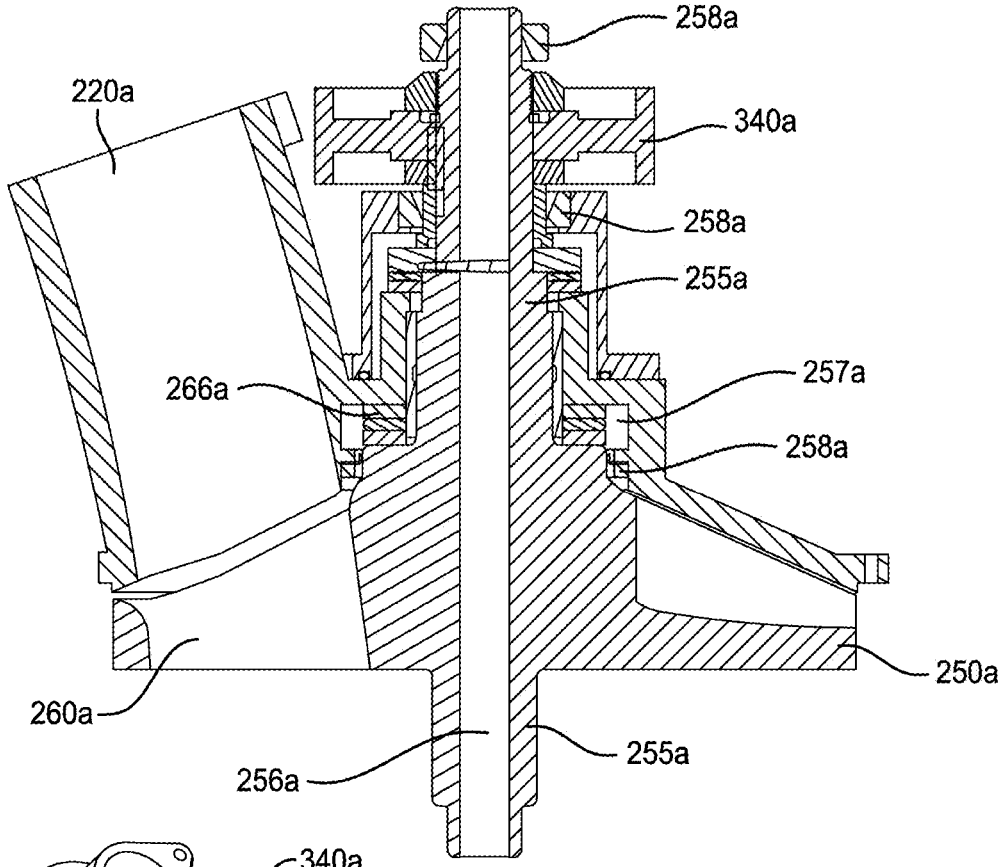
Figure 2C:
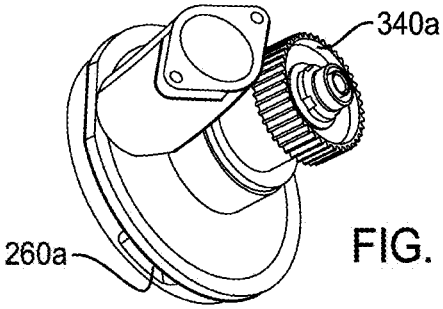

FIGS. 2A, 2B, and 2C illustrate an intake rotor system according to an example embodiment. FIG. 2A is a top view of the intake rotor system, and FIG. 2B illustrates a cross-section of the intake rotor system, taken along line A-A in FIG. 2A. FIG. 2C is a perspective view of the intake rotor system. At least one port in the head 200 is an intake port 220*a* used to fill the combustion chamber 55 with air for combustion in the engine. An intake system (not shown) is in communication with the atmosphere at one end and in communication with the intake port 220*a* at the other end, and the intake system may contain an air filtering system, a carburetor, or a fuel injection throttle body, turbo charger, blower, and an intake manifold, for example. Fuel injectors may be used to add fuel for combustion and may be included within the intake system or may inject directly into the combustion chamber 55. This list is not to be considered all-inclusive of intake system configurations and possible methods used for achieving a desired fuel/air mixture in the combustion chamber 55, and the example embodiments are not limited to those listed here.

Figure 3A:
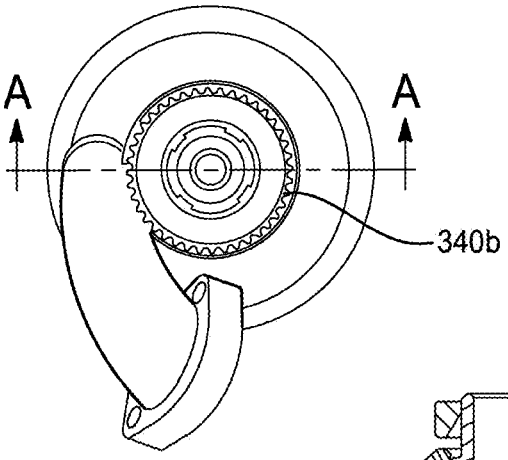
FIGS. 3A, 3B, and 3C are a top view, a cross-sectional view, and a perspective view, respectively, of an exhaust rotor system according to an example embodiment.
Figure 3B:
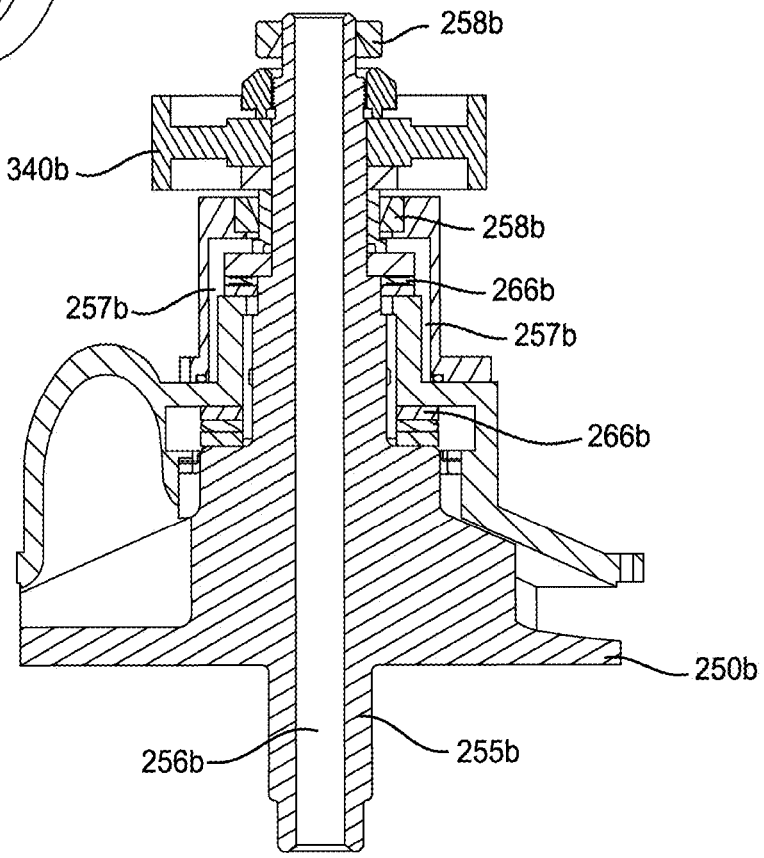
Figure 3C:
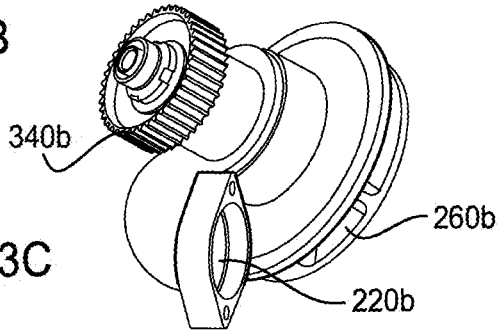

FIGS. 3A, 3B, and 3C illustrate an exhaust rotor system according to an example embodiment. FIG. 3A is a top view of the exhaust rotor system, and FIG. 3B illustrates a cross-section of the exhaust rotor system, taken along line A-A in FIG. 3A. FIG. 3C is a perspective view of the exhaust rotor system. At least one port in the head 200 is an exhaust port 220*b* used to remove burnt gases from the combustion chamber 55. An exhaust system (not shown) may be in communication with the exhaust port 220*b* on one end, and used to direct the gases away from the engine/exhaust port. At an opposite end, the exhaust system may be in communication with the atmosphere. An exhaust system may contain emission control components and/or sound control components. One of skill in the art would understand that this description of exhaust system configurations is merely an example and is not limiting.

With reference to FIGS. 1A, 1B, 2A-2C, and 3A-3C, in conjunction with each port 220*a*/220*b*, a plate 250*a*/250*b* is disposed such that it intersects the corresponding port at an angle approximately perpendicular to the flow of gas through the port 220*a*/220*b* at the intersection point. The plate 250*a*/250*b* is designed so that it can be moved so that the corresponding port 220*a*/220*b* can be opened, allowing communication between the combustion chamber 55 and atmosphere, or closed, sealing the combustion chamber 55 from the atmosphere. The plate 250*a*/250*b* may have a substantially flat portion and may be rotatable on an axis, as shown in FIGS. 1A, 1B, 2A-2C, and 3A-3C, for example, or it may slide and reciprocate (see FIGS. 4, 5A, 5B, 6A, and 6B), or rotate and reciprocate. The plate 220*a*/220*b* does not have to be flat and may be curved to increase its strength and rigidity. The thickness and shape of the plate 250*a*/250*b* are not limited to these descriptions, and any thickness and/or shape that achieves the opening and closing of the port 220*a*/220*b* may be used.

The plate 250*a*/250*b* may be made of aluminum and coated with a hard surface plating such as Nikasil. Alternately, the plate 250*a*/250*b* may be made from one or more of a variety of other metals, carbon fiber, other composite materials, or other material, combination of materials, and/or surface treatment, as would be understood by one of skill in the art.

The plate 250*a*/250*b* may rotate on a shaft 255*a*/255*b* that is approximately parallel to the port 220*a*/220*b* at the point of intersection between the port 220*a*/220*b* and the plate 250*a*/250*b*. The shaft 255*a*/255*b* and the plate 250*a*/250*b* together may be one, single piece, or the plate 250*a*/250*b* may be fastened to the shaft 255*a*/255*b*. Any method of construction may be used to build the plate 250*a*/250*b* so that it has a shaft 255*a*/255*b* on which it can rotate. An opening 260*a*/260*b* in the plate may allow the port 220*a*/220*b* to open when the plate 250*a*/250*b* is rotated and the opening 260*a*/260*b* aligns with the port 220*a*/220*b*.

Bearings 266*a*/266*b* may be used to support the plate shaft 255*a*/255*b* and reduce friction and wear as the plate 250*a*/250*b* rotates, and may be radial and/or thrust bearings. The bearings may be ball bearings, roller bearings, bronze bearings, or any other type of bearing, as would be understood by one of skill in the art.

Oil, provided in an oil passage 257*a*/257*b*, as shown in FIGS. 2B and 3B, may be used to reduce wear in the bearings 266*a*/266*b* and to aid in the cooling of the plate 250*a*/250*b*.

Seals 258*a*/258*b*, and 231 may be used to keep oil in areas designed to be exposed to oil, and out of the ports 220*a*/220*b* and/or combustion chamber 55.

Figure 4:
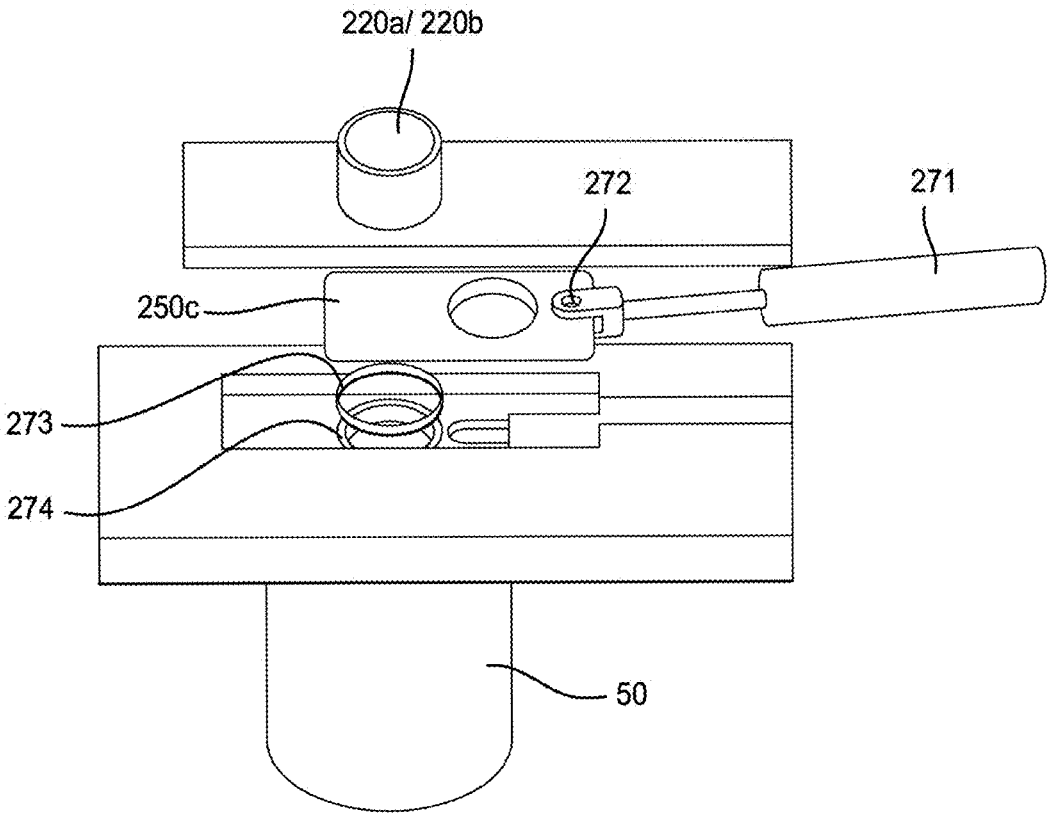
FIG. 4 is an exploded view of a plate system according to an example embodiment.
Figure 5A:
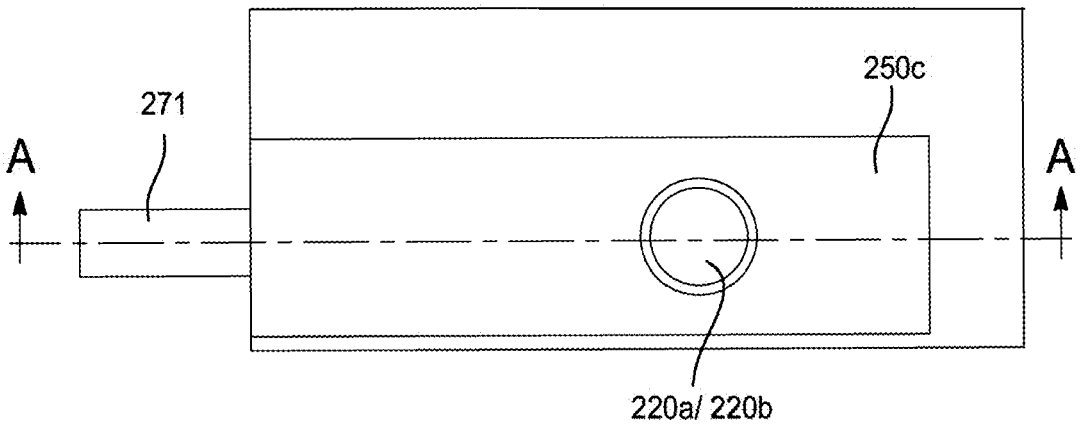
FIGS. 5A and 5B are a top view and a cross-sectional view of the plate system of FIG. 4 in an open position.
Figure 5B:
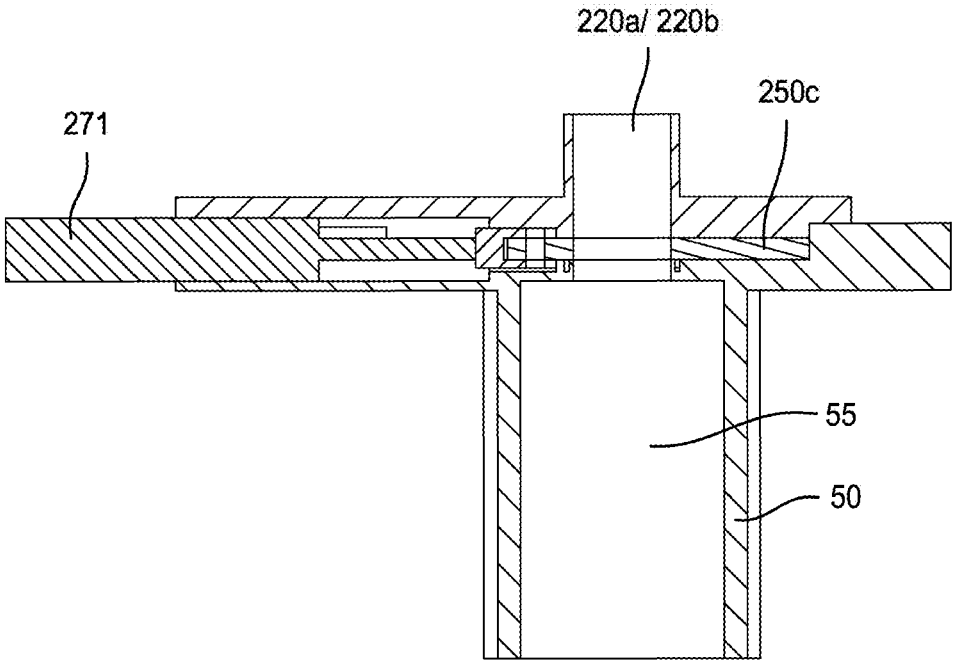
Figure 6A:
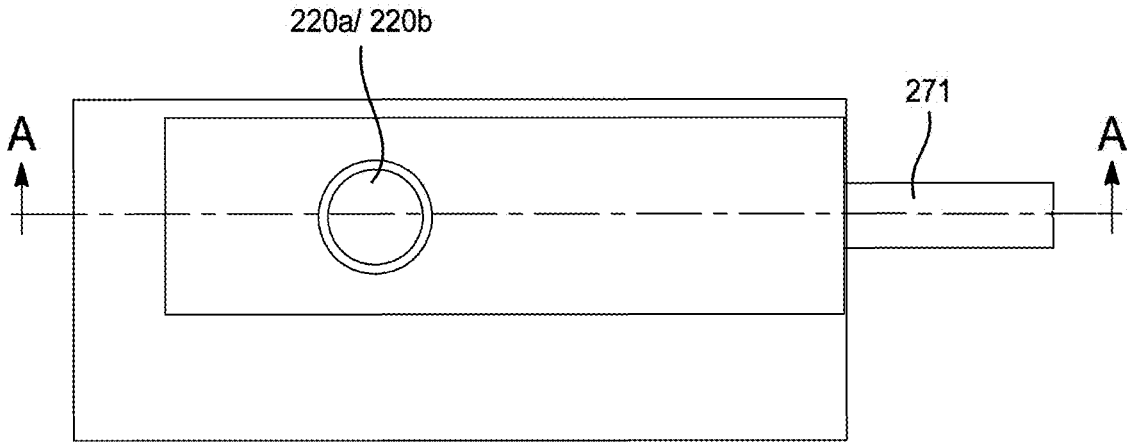
FIGS. 6A and 6B are a top view and a cross-sectional view of the plate system of FIG. 4 in a closed position.
Figure 6B:
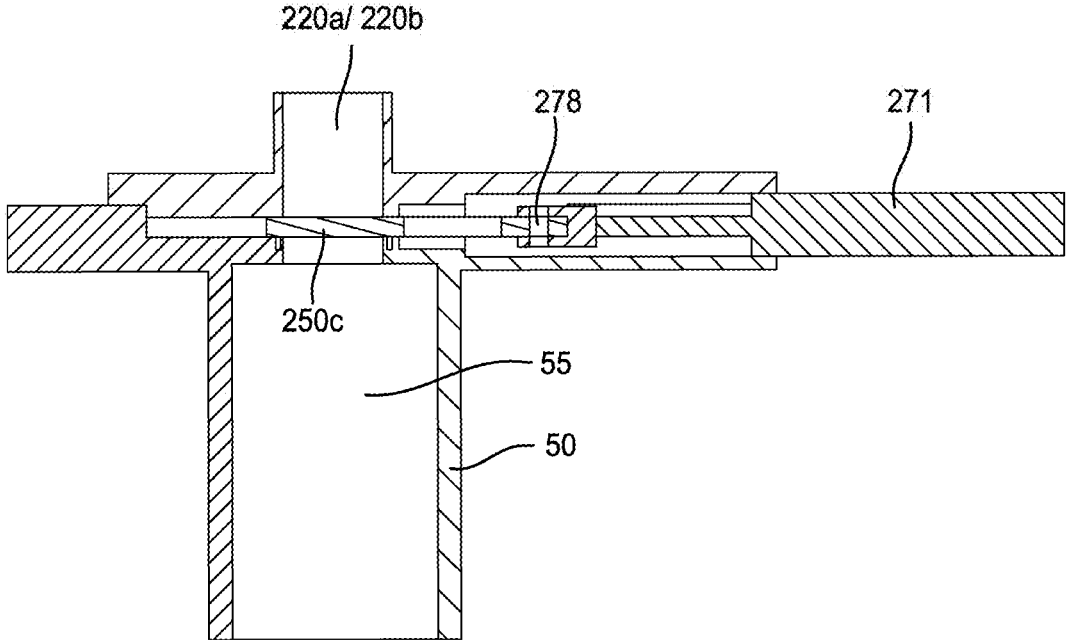

FIG. 4 illustrates an exploded view of an alternative embodiment of a plate system including a plate 250*c* which is slidable in a linear direction, according to an example embodiment. FIG. 5A illustrates a top view of the plate system of FIG. 4 in an open position, and FIG. 5B illustrates a cross-section of the plate system of FIG. 5A, taken along line C-C. FIG. 6A illustrates a top view of the plate system of FIG. 4 in a closed position, and FIG. 6B illustrates a cross-section of the plate system of FIG. 6A, taken along line A-A. As shown, the plate 250*c* may move in a linear motion, acting as a guillotine to thereby open and close the corresponding port 220*a*/220*b*. An actuator 271 may be attached to the plate 250*c*, as by a pin 272, for example, as shown in FIG. 4, in order to control the sliding motion of the plate 250*c*. Alternately, the plate 250*c* may move in a reciprocating rotational movement.

A sealing device may provide a seal between the plate 250*c*, where it is exposed to the port 220*a*/220*b* on the combustion chamber side of the plate 250*c*, and the head surrounding the port, when the port is closed. The sealing device may effectively seal the combustion chamber 55 within the cylinder 50 from the port 220*a*/220*b* at the appropriate time during the compression and power stroke. As shown in FIG. 4, the sealing device may comprise a compression ring 273 that surrounds the intake or exhaust port 220*a*/220*b* in the head. The head may have a ring groove 274 that surrounds the port 220*a*/220*b*. The ring groove may optionally include a pin (not shown) that locates the ring 273 and prevents the ring 273 from rotating in the groove 274. The ring 273 may be a continuous ring that fits accurately in the ring groove 274. The ring 273 may be a split ring that allows any pressure that leaks into the ring groove 274, from the combustion chamber 55, to press the ring 273 outward to provide a seal on the side of the ring groove 274. A wavy spring (not shown) may be used between the bottom of the ring groove 274 and the bottom of the ring 273. The spring may thereby apply pressure against the ring 273, causing the ring 273 to stay in contact with the plate 250*c*, and may maintain pressure between the sealing surface of the ring 273 and the plate 250*c*, as the plate 250*c* moves across the sealing surface of the ring 273. The combustion pressure that pushes the ring 273 against the side of the ring groove 274 may also push the ring 273 against the plate 250*c* to assist the seal between the plate 250*c* and the ring 273.

Multiple rings may be used to achieve a seal at each port. The rings may be round and each fit into a round ring groove. However, the shape of the ring(s) and groove(s) may be any shape to allow for differently-shaped ports. The material used for construction of the ring may be cast iron, carbon, graphite, steel, alloy, or any of a variety of other materials appropriate for use in piston compression rings, as would be understood by one of skill in the art.

Returning to the example embodiment of FIGS. 1A, 1B, 2A-2C, and 3A-3C, including the rotating plates 250*a*/250*b*, according to an example embodiment, the rotating motion of the engine crankshaft may be used to drive the plates 250*a*/250*b* and time the opening and closing of the ports 220*a*/220*b*.

Figure 7A:
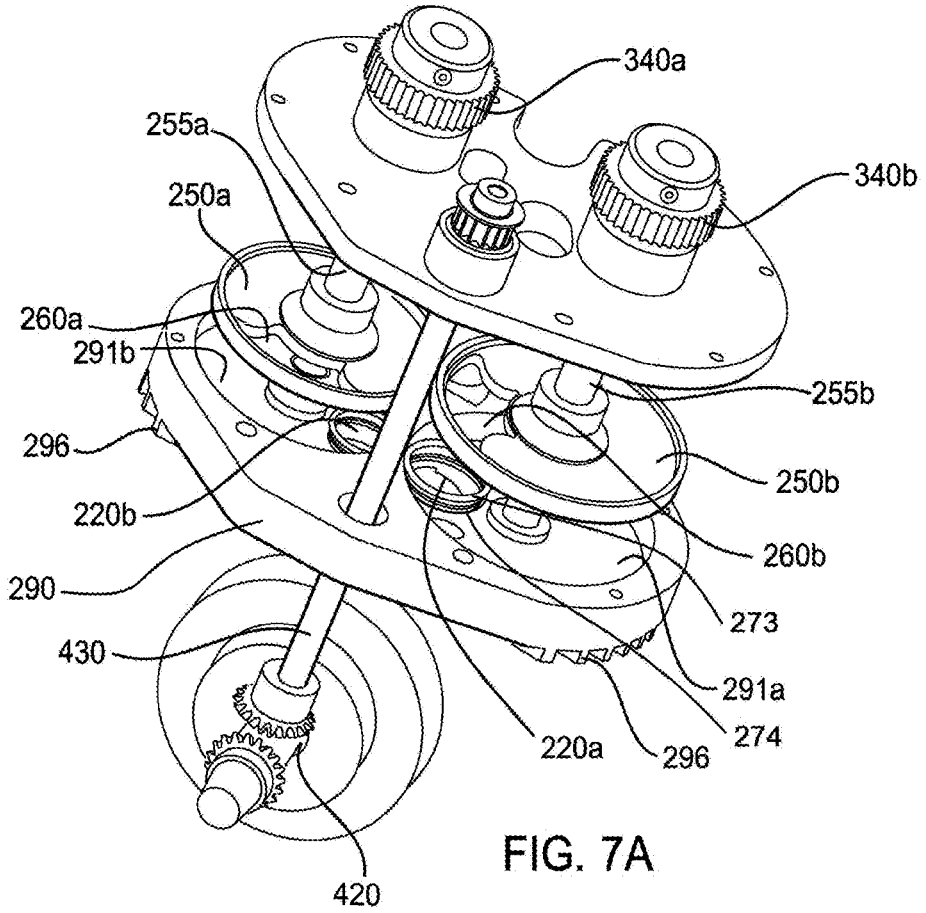
FIG. 7A is an exploded view of an assembly configured to drive plates according to an example embodiment.

FIG. 7A illustrates an example embodiment of an assembly in which the crankshaft is used to drive the plates. Gears 420, one or more shafts 430, and/or one or more belts (not shown) and pulleys 440, 340*a*, and 340*b*, and/or chain and sprockets (not shown), may be used to redirect the rotating motion of the crankshaft to rotate the plates 250*a*/250*b* on their axes. It should be understood that the source of driving and timing the plates 250*a*/250*b* is not limited to the crank shaft and another method may be used to control the plates' movement and timing. One non-limiting example of another method may be an electromagnetic actuator to control the plate movement and timing. The plates 220*a* and 220*b* may rotate at half of the crankshaft speed to allow a single cutout 260*a*/260*b* in each plate to open the corresponding port 220*a*/220*b* every other rotation of the crank.

A rotor cover 251, as shown in FIG. 1B, may be used to enclose the plates 250*a*/250*b* and may create a continuation of the ports 220*a*/220*b* in the head 200 on the non-combustion chamber side of the plates 250*a*/250*b*, and create an area via which the exhaust or intake systems may be connected to the appropriate port 220*a*/220*b*. The rotor cover 251 may include one or more bearings to maintain alignment of the shafts 255*a* and 255*b*, and may include seals containing lubricating oil that may lubricate the bearing(s).

The rotor cover 251 may include cooling fins (not shown) about an exterior surface thereof. The heat generated in the combustion chamber 55 may be conducted through the material of the head 200 and valve cover and dissipated through the cooling fins that are cooled by air flowing over them. Alternately, there may be passages, in and/or around the head 200 and/or rotor cover, and may be in communication with a radiator/cooling system (not shown) that may contain a liquid coolant that circulates within the radiator/cooling system. Alternately, a fan or another method as would be understood by one of skill in the art may be used to cool the rotor cover.

High combustion chamber pressures during the power stroke may cause extreme pressure on the portion of the plate 250*a*/250*b* in communication with the combustion chamber 55. The pressure may cause the plate 220*a*/220*b* to deflect away from the head 200 and sealing device, e.g. rings 273 and ring grooves 274. One or more of an upper sealing device, sealing an area between an upper surface of the plate 250 and the rotor cover 251; and a lateral sealing device, sealing between an outer circumference of the plate 250 and a portion of the rotor cover 251 or base support 290 enclosing the plate 250, may be provided. A passage may be in communication with the combustion chamber on one end and the effectively-sealed area around the plate 250. The side load on the plates 250*a*, 250*b* may thereby be reduced because as the pressure in the combustion chamber 55 increases the passage allows the pressure to equalize in the sealed areas around the plates 250*a*, 250*b*.

According to one or more example embodiments, bearings may be placed so that they support the plates 250*a*, 250*b*, in the area around the ports 220*a*,220*b*, against the pressure in the combustion chamber 55. This may be a ball or roller bearing, a Teflon bearing surface, or any other design or material that may come in contact with the plate 250*a*/250*b* to stop or limit deflection of the plate 250*a*/250*b* due to pressure in the combustion chamber 55.

As shown in FIG. 7A, the head 200 may include a base support 290 with counterbores 291*a* and 291*b* formed therein or an area that receives each plate 250*a*/250*b* and allows rotation of the plates. A ports 220*a*, 220*b* are formed through the base support 290 within the counterbores 291*a*, 291*b*. A port 220*a*/220*b* is closed when the corresponding plate 250*a*/250*b* is disposed within the counterbore 291*a*/291*b* and rotated so that the opening 260*a*/260*b* is not aligned with the port 220*a*/220*b*. Shafts 255*a*, 255*b* are located in central areas of, and perpendicular to the respective counterbores 291*a*, 291*b* and are fixed to the respective plates 250*a*, 250*b* and rotate therewith. Alternately, for example, a bearing may be included in a central area of each counterbore 291*a*/291*b*, and a the shafts 255*a*, 255*b* may rotate on the bearings.

The shafts 255*a*, 255*b* may extend substantially perpendicular to a flat sealing face of the plates 250*a*, 250*b*. Sealing faces of the plates 250*a*, 250*b* may be plated with a hard surfacing material. The plating may be Nikasil or another material. The plates 250*a*, 250*b* may rotate in the respective counterbores 291*a*, 291*b*, in the base support 290 of the head 200, with the sealing surface of each of the plates 250*a*, 250*b* facing the base support 290.

The shafts 255*a*, 255*b* may extend beyond the respective sealing surfaces and may have bearing areas that rotate within axial bearings 231 disposed in shaft recesses 286*a*, 286*b* (see, e.g. FIG. 7B) within the counterbores 291*a*, 291*b* in the base support 290. An oil supply passage may supply oil under pressure to a bearing. A seal 232 may be placed on either side of a bearing to contain oil within dedicated oil passages. The seal may be Teflon or another suitable material to endure the heat. The seal may be, but is not limited to, a Viton lip seal.

The plates 250*a*,250*b* may have a stiffening structure on sides thereof opposite the sealing surface. A thrust roller bearing 233 (see FIG. 1B) may be used to bear upward forces of cylinder combustion against the rotating plate 250*a*/250*b*. The shaft 255*a*/255*b* may extend away from the sealing surface and may have a bearing area that rotates within an axial bearing.

A thrust plate may be fastened to the rotor shaft, above a rotor cover, to provide a bearing surface for a roller thrust bearing, to bear any thrust load in a direction toward the head.

A seal may be disposed on either side of a bearing, or combination of bearings, to contain oil within dedicated oil passages. Such a seal may be Teflon or another material, and may be, for example, a Viton lip seal. A seal may contact a rotor shaft directly or may contact a sleeve placed on a rotor shaft. An o-ring may be used to seal between a sleeve and a rotor shaft.

Figure 7B:
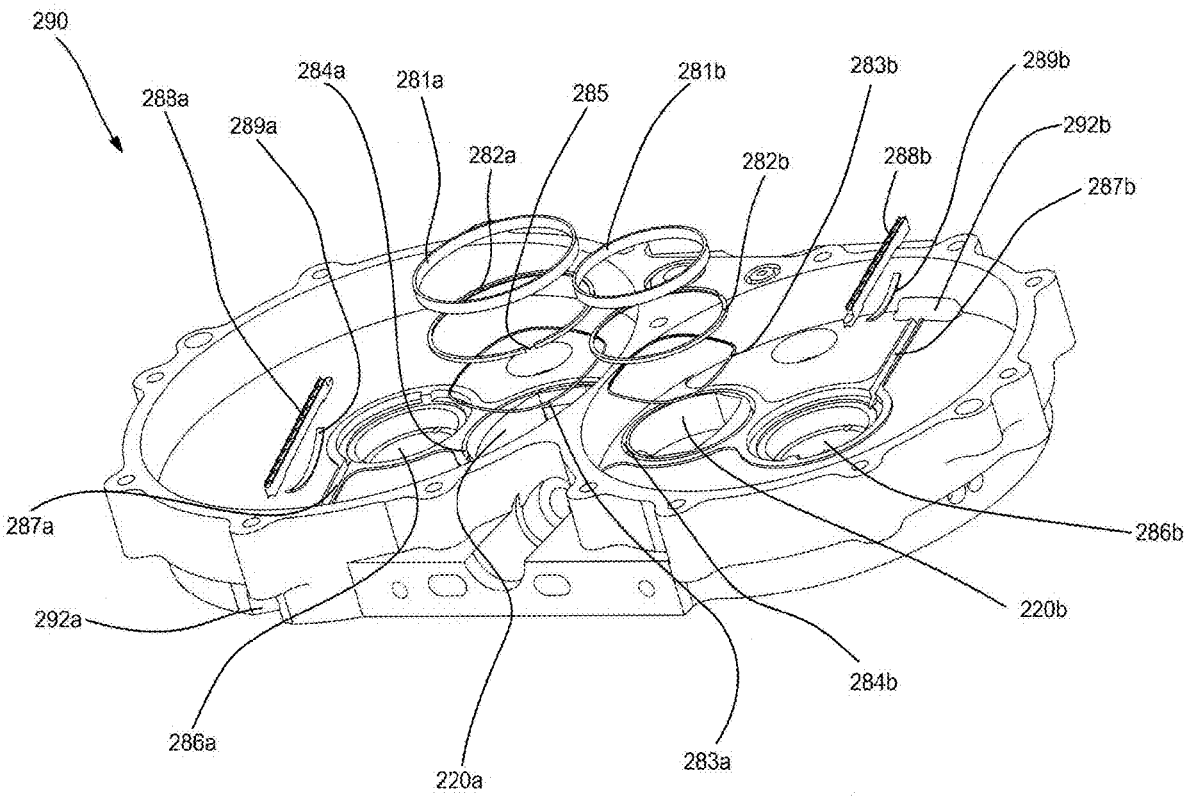
FIG. 7B is an exploded view showing a base support of an engine head according to an example embodiment.

FIG. 7B illustrates an exploded view showing a base support 290 of an engine head according to one or more example embodiments. According to this example, the sealing devices, providing a seal between the plates 250*a*, 250*b* (not shown) and the base support 290 around the respective ports 220*a*, 220*b*, each include an upper ring 281, a lower ring 282, and a spring 283, all disposed within a ring groove 284 formed in the base support 290. The upper rings 281*a*, 281*b* are continuous (gapless) loops (e.g. circle), each providing an unbroken seal preventing leaking of compression through a gap between the respective plate and the base support 290. The upper rings 281*a*, 281*b* are solid and have comparatively very little expansion from compression, as compared to split rings. Thus, leakage between the upper rings 281*a*, 281*b* and the outer circumferences of the respective ring grooves 284*a*, 284*b* is possible. The lower rings 282*a*, 282*b* are split rings, each split to enable greater expansion as compared to the continuous upper rings 281*a*, 281*b*. Each lower ring 282 may be split to include a radial gap 285, as shown in FIG. 7B. Alternately, each lower ring may be split helically, or in another manner, as would be understood by one of skill in the art. Upper surfaces of the lower rings 282*a*, 282*b* seal against lower surfaces of the respective upper rings 281*a*, 281*b*, and due to the split/gap 285, the lower rings 281*a*, 281*b* are expandable by pressure to thereby seal outer diameters of the lower rings 282*a*, 282*b* against the outer circumferences of the respective ring grooves 284*a*, 284*b*. The splits/gaps 285 in the lower rings 282*a*, 282*b* may be sealed by the lower surfaces of the respective upper rings 281*a*, 281*b*. A spring 283 may be positioned within each ring groove 284, between a bottom of the ring groove 284 and the bottom of the lower ring 282 to exert upward pressure on the lower ring 282 to maintain sealing contact between the lower ring 282 and the upper ring 281 even when there is no pressure in the combustion chamber. Within each ring groove 284, the spring 283 also exerts pressure to maintain the upper ring 281 in contact with the respective plate even when there is no pressure in the combustion chamber. An outer diameter of the lower ring 282 when in an uncompressed state may be larger than an outer diameter of the ring groove 284 such that the lower ring 282 must be compressed to be inserted into the ring groove 284. Thus, the compression of the lower ring 282 maintains the sealing contact between the lower ring 282 and the ring groove 284, even when there is no pressure in the combustion chamber. According to one example, the sealing elements may include no spring, and the lower rings 282*a*, 282*b* may be helically split, such that compression of the lower rings 282*a*, 282*b* exerts pressure which maintains the seals between the respective lower rings 282*a*, 282*b* and the outer circumferences of the respective ring grooves 284*a*, 284*b*, and also maintains the seals between the lower surfaces of the upper rings 281*a*, 281*b* and the upper surfaces of the respective lower rings 282*a*, 282*b*.

FIG. 7B also illustrates shaft recesses 286*a*, 286*b* formed within the respective counterbores 291*a*, 291*b* in the base support 290, each shaft recess 286 configured to support a lower end of a shaft 255 with bearings (not shown). As discussed above, the bearings may be radial and/or thrust bearings including, for example, ball bearings, roller bearings, bronze bearings, or any other type of bearing, as would be understood by one of skill in the art, and oil may be provided within the shaft recesses 286*a*, 286*b* to reduce wear on the bearings and aid in cooling of the plates 250*a*, 250*b*.

According to one or more example embodiments, wiper grooves 287*a*, 287*b* may be formed within the respective counterbores 291*a*, 291*b* in the base support 290. An oil wiper 288 and spring 289 may be disposed in each wiper groove 287. As shown, a wiper groove 287 may be formed within a counterbore 291, extending substantially radially outward from a shaft recess 286 to a drain 292 disposed at an outer circumference of the counterbore 291. In a case in which no shaft recess 286 is formed in the counterbore 291, a wiper groove 287 may extend between an inner circumferential region of the counterbore 291, e.g. adjacent to where a shaft 255 would be positioned, to an outer circumferential region of the counterbore 291, e.g. to a drain 292. The wiper 288 is disposed in the wiper groove 287 on top of the spring 289. The spring 289 is biased to maintain the wiper in contact with a lower surface of the plate. The wiper groove 287, and the wiper 288 therein, may be angled with respect to a radius of the counterbore 291, as would be understood by one of skill in the art, in order to, along with centrifugal acceleration and a rotating motion of the plate 250, move oil outward toward the outer circumference of the plate 250 and the counterbore 291, for example, to a drain 292.

The head 200 may include one or more sparkplugs (not shown) therein, such that the sparking electrode communicates with the combustion chamber 55 to ignite the air/fuel mixture to begin the power stroke.

The head 200 may have cooling fins 296 about the exterior surface. The heat generated in the combustion chamber 55 may be conducted through the material of the head 200 and dissipated through fins 296 that are cooled by air flowing over them. Alternately, there may be passages (not shown), in and/or around the head and/or a valve cover, containing a liquid coolant that circulates within a radiator/cooling system. The plate 250*a*/250*b* may contain a passage 256 in a shaft 255 allowing a liquid coolant to be in contact with the plate 250*a*/250*b*. Alternately, a fan or another method as would be understood by one of skill in the art may be used to cool the head 200.

The head 200 may be made of aluminum and cast or may be machined from solid stock. However, this description of aluminum is not limiting, and any material, construction, or manufacturing process appropriate for a four stroke head may be used.

Figure 7C:
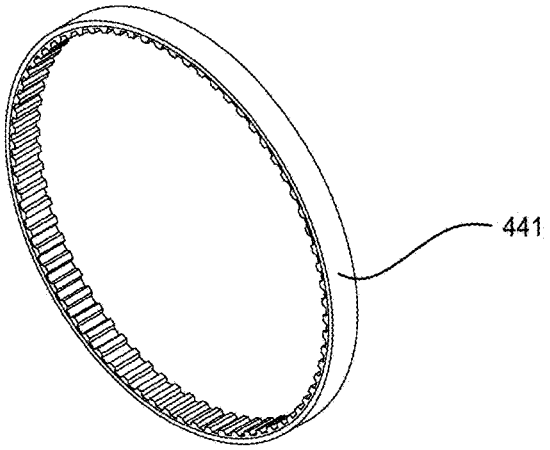
FIG. 7C is a timing belt according to an example embodiment.

FIG. 7C illustrates a toothed timing belt. According to an example embodiment, the timing belt 441 is disposed around pulleys 440, 340*a*, and 340*b*, and accordingly, pulleys 340*a* and 340*b* may be used to drive the rotating plates 250*a*/250*b*. The duration of the intake or exhaust event may be controlled by the dimensions of the opening 260*a*/260*b* in the plate 250*a*/250*b*. However, one advantage of belt driven plates is that a single or series of belt tensioners (see FIGS. 9A-9C) may be used between the drive and driven pulleys, and/or between the driven pulleys. This movement, whether individually or together, can advance or retard the centerline of the opening 260*a*/260*b* in the plate 250*a*/250*b* in relation to the crank location. The movement of the tensioners may be controlled electronically using an actuator 451 (FIG. 9C) or mechanically, and may be controlled during operation of the engine to enable the optimum valve timing for a given rpm, load, or efficiency. The tensioners may comprise a bearing that rotates on an axle that is movable and the bearing may directly or indirectly contact the belt 441. The pulleys 340*a* and 340*b* may be pinned to the plate shafts 255*a* and 255*b*, respectively, and may use multiple locations to provide incremental adjustment. Alternately, a splined shaft and pulley (not shown) may be used to allow adjustment. Mounting screws in a slot may also be used to allow rotational adjustment between the pulley 340*a*/340*b* and the plate 250*a*/250*b*. It should be understood that any method may be used to mount the pulleys to the plate shafts and allow incremental rotational adjustment thereamong.

Figure 8A:
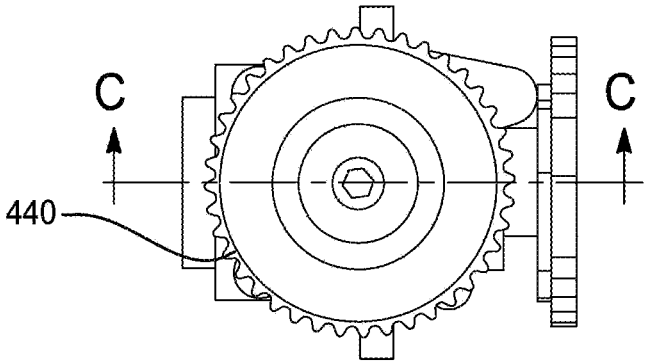
FIGS. 8A, 8B, and 8C are a top view, a cross-sectional view, and a perspective view of a gear case according to an example embodiment.
Figure 8B:
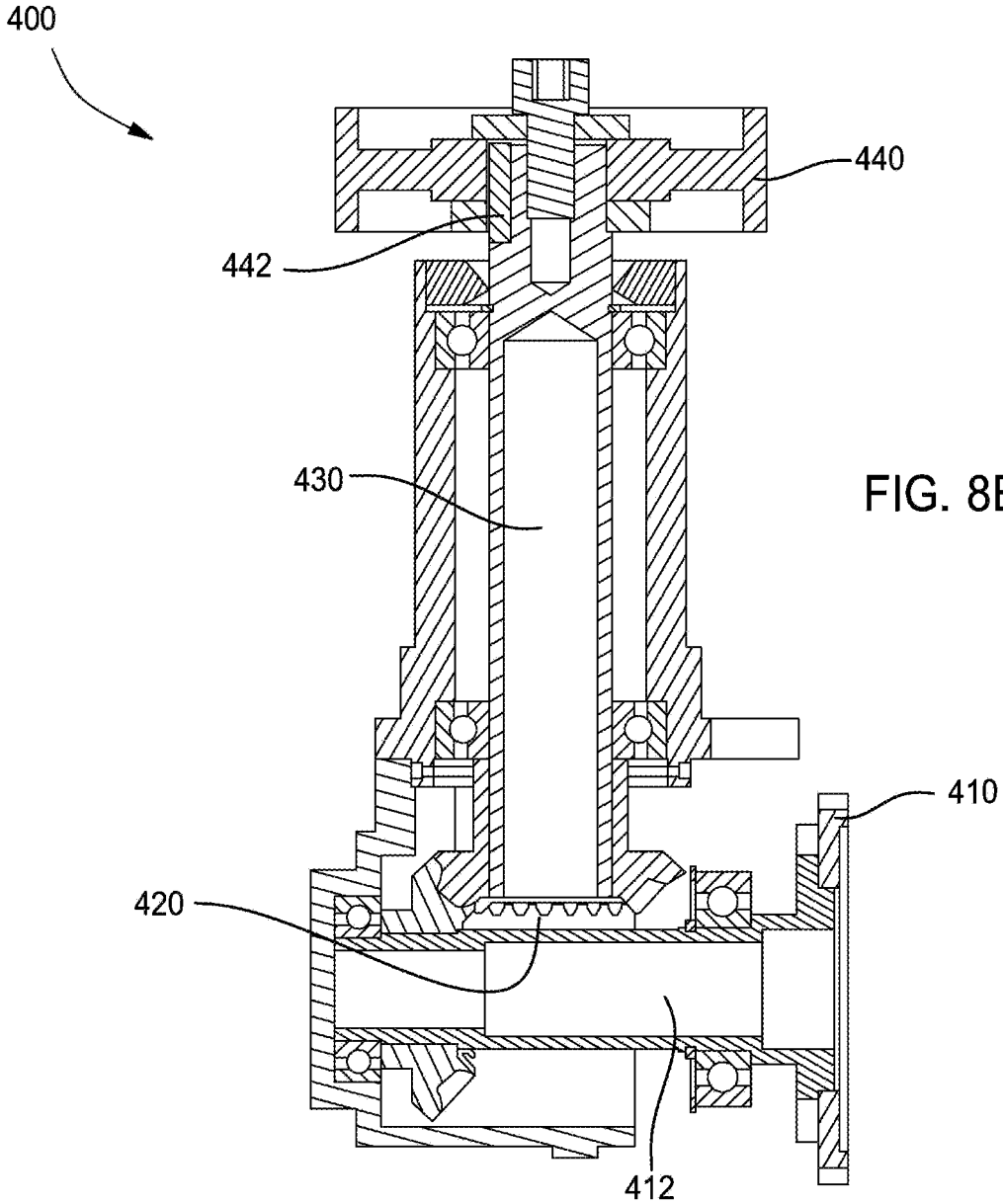
Figure 8C:
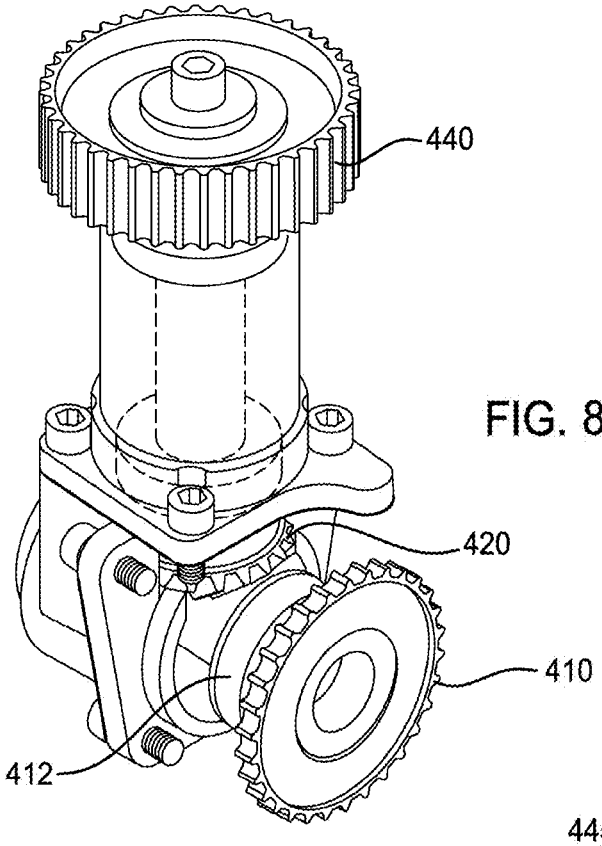

According to an example embodiment, the rotation of the driveshaft 430 is used to drive and time rotation of the plates 250*a*/250*b*. FIGS. 8A, 8B, and 8C illustrate a gear case 400 according to an example embodiment. FIG. 8A is a top view of the gear case 400, and FIG. 8B is a cross-section taken along the line C-C in FIG. 8A. FIG. 8C is a perspective view of the gear case 400.

According to an example embodiment, a chain and sprocket 410 may be used to transfer a rotating motion of a crankshaft to a set of miter gears 420, which may change the axis of rotation to one that is perpendicular or nearly perpendicular to an axis of the crankshaft.

The plates 250*a*/250*b* may be made to turn at half the crankshaft speed to provide a proper port timing.

A rotating speed of the crankshaft may be reduced to half by a gear ratio of sprockets, e.g. sprocket 410, mounted on a crankshaft and an input shaft 412 driving a set of miter gears 420. There may be a device to adjust the tension of the chain.

The miter gear ratio may be 1 to 1. A rotor drive shaft 430 may rotate perpendicular to or nearly perpendicular to the cylinder 50. The rotor drive shaft 430 may have a toothed pulley 440 mounted on it. A key 442 and keyway may be used to prevent rotation of the pulley 440 with respect to the rotor drive shaft 430. Alternately, a spline (not shown) or other method may be used to prevent the pulley 440 from rotating with respect to the rotor drive shaft 430. The toothed timing belt 441 may be used to time and drive the pulleys 340*a* and 340*b* connected to the rotating plates 250*a* and 250*b*.

Alternately, the miter gears 420 may be driven by the crankshaft directly and may have a ratio that reduces a rotation of the rotor driveshaft 430 to half that of the crankshaft. Alternately, the rotor drive shaft 430 may have miter gears 420 driven directly off the crankshaft and turning at the same speed as the crankshaft, and one or more pulleys and the timing belt 441, or other suitable method, may be used reduce the plates 250*a* and 250*b* at half of the crankshaft speed.

Alternately, plates 250*a* and 250*b* may be timed and driven by a chain or chains and sprockets (not shown) fastened to the plates 250*a* and 250*b*

It should be understood that many combinations of gear ratios and drive methods could be used to rotate and time a plate at half the crankshaft speed.

Engine performance is dependent, in part, on the timing of events, such as the opening and closing of the ports 220*a* and 220*b* by the openings 260*a* and 260*b* in the plates 250*a* and 250*b*. Optimum timing varies with engine rpm.

According to an aspect of an example embodiment, a belt tensioner, comprising two idler pulleys, adjustable arms, and adjusting mechanism, may be used to adjust the tension in the timing belt 441 (see FIGS. 7A and 7B).

Figure 9A:
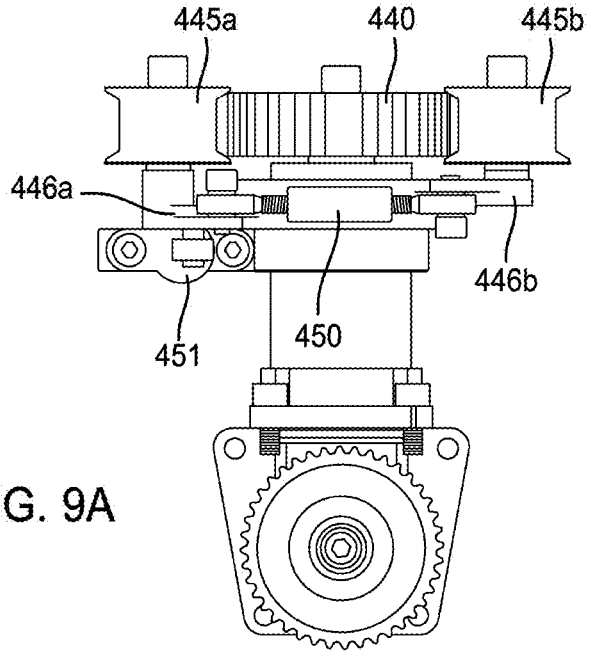
FIG. 9A is a cross-section and FIGS. 9B and 9C are perspective views of a variable timing unit according to an example embodiment.
Figure 9B:
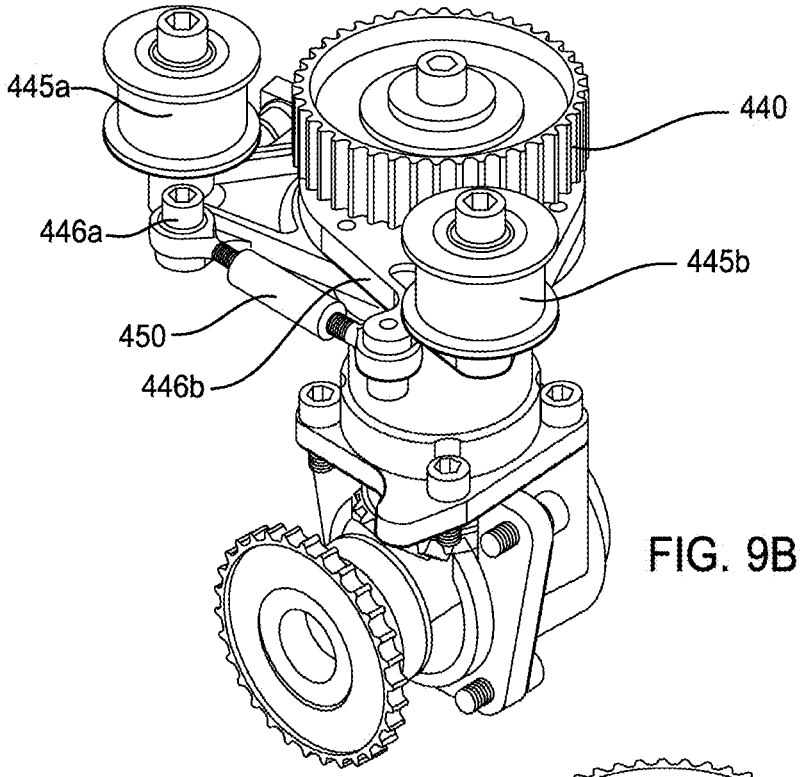
Figure 9C:
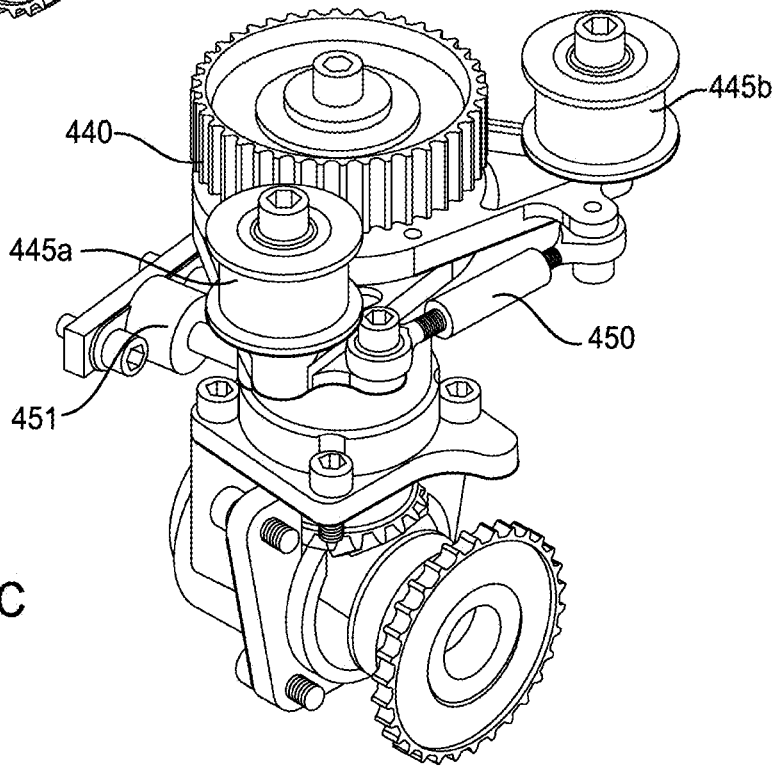

FIGS. 9A, 9B, and 9C illustrate a variable timing unit according to an example embodiment. FIG. 9A illustrates a cross-section of the variable timing unit, and FIGS. 9B and 9C illustrate different perspective views of the variable timing unit. For each of the pulleys 340*a* and 340*b*, a corresponding idler pulley 445*a*/445*b* may be mounted on an arm 446*a*/446*b* that rotates on an axis. An idler pulley 445*a*/445*b* may rotate on bearings, on an axis parallel to the axis on which the corresponding arm rotates. The two arms may rotate on a same axis and each arm 446*a*/446*b* may be attached to an idler pulley 445*a*/445*b* mounted a same distance from the axis on which the arm 446*a*/446*b* rotate. An angle of the arms 446*a* and 446*b*, in relation to each other, may be adjusted by an adjustable length rod 450. The axis on which the arms 446*a* and 446*b* rotate may be the same as that of one of the pulleys 340*a* and 340*b* or that of the rotor drive pulley 440. The arms 446*a* and 446*b* may be mounted so that the pulleys 445*a* and 445*b* contact an outside of the belt 441 (see FIGS. 7A and 7B), such that when the angle between the arms 446*a* and 446*b* is decreased, the belt tension is increased.

When the belt tension is correct, the angle between the arms 446*a* and 446*b* may be locked. This locked adjuster, along with the idler pulleys 445*a* and 445*b* and arms 446*a* and 446*b*, thus function as a variable timing unit that may rotate on the same axis as one of the pulleys 440, 340*a* and 340*b*. Rotation of the variable timing unit increases deflection of one leg of the belt 441 while decreasing deflection of an opposing leg of the belt 441. The relation of the pulley 440, 340*a*, or 340*b*, sharing the axis with the variable timing unit, to the other pulleys 440, 340*a*, and 340*b* is advanced or retarded depending on the direction of movement.

The variable timing unit may be rotated by an adjustable rod fastened to a variable timing unit and a fixed mount and adjusted manually.

According to an aspect of an example embodiment, the variable timing unit may be held by a spring (not shown) in an advanced or retarded position. As engine rpm increases, centrifugal force on rotating weights may be used to move the variable timing unit against a spring to advance or retard the position of the pulley 440, 340*a*, or 340*b*, sharing the axis of the variable timing unit, compared to the other pulleys 440, 340*a*, or 340*b*, driven by the same belt 441.

Yet another example of a variable timing unit control may use an electromagnetic actuator, controlled by the engine control unit (ECU), to accurately advance or retard the timing of the valve events for a particular rpm.

The head 200 may be mounted to the end of the 50 cylinder, to form the combustion chamber 55, and may be held in place by head bolts. The interface between the head 200 and cylinder 50 may be sealed by a head gasket.

The cylinder 50, head 200, rotor cover 251, and plates 250*a* and 250*b* may be cooled by liquid coolant being pumped through them by an engine-driven pump (not shown).

Coolant may circulate through cooling passages (not shown) that surround the wall of the bore of the cylinder 50. A head gasket may have holes therein that allow communication among cooling passages that surround the wall of the bore of the cylinder 50 and cooling passages in and/or surrounding the head and or portions of the head 200.

The shafts 255*a* and 255*b* may each have a shaft 255*a*/255*b*, containing a cooling passage 256*a*/256*b*. The cooling passage 256*a*/256*b* may be in communication, at one end, with the cooling passages in the cylinder, and also in communication with a passage (not shown) that may return the coolant to a cooling radiator.

A rotor cover 251 may contain cooling passages therein that are in communication with cooling passages in and/or surrounding the head and/or portions of the head at one end and also in communication with a passage that may return the coolant to a cooling radiator.

It should be understood that any means may be used to supply and circulate coolant through coolant passages in and/or around the head, rotor covers, and rotors. Coolant may, but does not have to, pass through the cylinder first.

A head gasket may have a hole that allows communication between a pressurized oil supply passage, in the cylinder 50, and an oil passage in the head 200. An oil passage in the head 200 may supply oil under pressure to bearings in the head 200.

There may be more than one intake and more than one exhaust rotor plates.

A one-way reed valve may be installed in the intake port to prevent gases from the combustion chamber 55 from reentering the intake port 220*a*, in the event that pressure in the cylinder 50 is greater than pressure in the intake port 220*a*, before the rotor plate closes.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. An engine head, comprising:

a base configured to be attached to an end of a cylinder, such that a combustion chamber is defined by walls of the cylinder and a lower surface of the base, wherein the base comprises:

a first counterbore formed therein and an intake opening disposed within the first counterbore and providing communication between an upper surface of the base and the lower surface of the base, and a second counterbore formed therein and an exhaust opening disposed within the second counterbore and providing communication between the upper surface of the base and the lower surface of the base an intake assembly comprising a first plate disposed within the first counterbore and comprising a first opening therein, wherein the intake assembly is rotatable between a first closed position in which the first plate blocks the intake opening in the base, and a first open position in which the first opening in the intake plate is aligned with the intake opening in the base;

an exhaust assembly comprising a second plate disposed within the second counterbore and comprising a second opening therein, wherein the exhaust assembly is rotatable between a second closed position in which the second plate blocks the exhaust opening in the base, and a second open position in which the second opening in the exhaust plate is aligned with the exhaust opening in the base;

a first sealing device comprising a first upper ring and a first lower ring disposed in a first ring groove formed within the first counterbore around the intake opening, wherein the first upper ring is a continuous ring, and the first lower ring is a split ring; and a second sealing device comprising a second upper ring and a second lower ring disposed in a second ring groove formed within the second counterbore around the exhaust opening, wherein the second upper ring is a continuous ring, and the second lower ring is a split ring.

2. The engine head according to claim 1, further comprising:

a first bearing configured to support the first plate against a pressure in the combustion chamber; and a second bearing configured to support the second plate against a pressure in the combustion chamber.

3. The engine head according to claim 1, wherein:

the first sealing device further comprises a first spring disposed within the first ring groove, wherein the first spring is biased to exert pressure between the ring groove and the first lower ring; and the second sealing device further comprises a second spring disposed within the second ring groove, wherein the second spring is biased to exert pressure between the second ring groove and the second lower ring.

4. The engine head according to claim 1, wherein:

the base further comprises a first shaft recess formed within the first counterbore and a second shaft recess formed within the second counterbore;

the intake assembly further comprises a first shaft fixed to and rotatable with the first plate, wherein the first shaft extends into the first shaft recess; and the exhaust assembly further comprises a second shaft fixed to and rotatable with the second plate, wherein the second shaft extends into the second shaft recess.

5. The engine head according to claim 4, further comprising:

a first wiping device comprising a first wiper and a first spring disposed in a first wiper groove formed in the first counterbore and extending from the first shaft recess to an outer circumference of the first counterbore, wherein the first spring is disposed under the first wiper and is biased to exert upward pressure on the first wiper against a lower surface of the first plate; and a second wiping device comprising a second wiper and a second spring disposed in a second wiper groove formed in the second counterbore and extending from the second shaft recess to an outer circumference of the second counterbore, wherein the second spring is disposed under the second wiper and is biased to exert upward pressure on the second wiper against a lower surface of the second plate.

6. The engine head according to claim 5, wherein the base further comprises a first drain opening at the outer circumference of the first counterbore and in communication with the first wiper groove and a second drain opening in the outer circumference of the second counterbore and in communication with the second wiper groove.

7. The engine head according to claim 4 further comprising:

at least one oil passage in the engine head configured to provide oil under pressure to the first shaft recess and the second shaft recess.

8. An engine head, comprising:

a base configured to be attached to an end of a cylinder, such that a combustion chamber is defined by walls of the cylinder and a lower surface of the base, wherein the base comprises:

a first counterbore formed therein and a first shaft recess formed within the first counterbore, and a second counterbore formed therein and a second shaft recess formed within the second counterbore;

an intake rotor assembly comprising a first plate disposed in the first counterbore and a first shaft extending into the first shaft recess, wherein the first shaft is fixed to and rotatable with the first plate such that the intake rotor assembly is rotatable with respect to the base;

an exhaust rotor assembly comprising a second plate disposed in the second counterbore and a second shaft extending into the second shaft recess, wherein the second shaft is fixed to and rotatable with the second plate such that the exhaust rotor assembly is rotatable with respect to the base;

a first wiping device comprising a first wiper and a first spring disposed in a first wiper groove formed in the first counterbore and extending from the first shaft recess to an outer circumference of the first counterbore, wherein the first spring is disposed under the first wiper and is biased to exert upward pressure on the first wiper against a lower surface of the first plate; and a second wiping device comprising a second wiper and a second spring disposed in a second wiper groove formed in the second counterbore and extending from the second shaft recess to an outer circumference of the second counterbore, wherein the second spring is disposed under the second wiper and is biased to exert upward pressure on the second wiper against a lower surface of the second plate.

9. The engine head according to claim 8, wherein the base further comprises a first drain opening at the outer circumference of the first counterbore and in communication with the first wiper groove and a second drain opening in the outer circumference of the second counterbore and in communication with the second wiper groove.

10. The engine head according to claim 8, further comprising:

at least one oil passage in the engine head configured to provide oil under pressure to the first shaft recess and the second shaft recess.

11. The engine head according to claim 8, further comprising:

a first bearing configured to support the first plate against a pressure in the combustion chamber; and a second bearing configured to support the second plate against a pressure in the combustion chamber.

* * * * *